US005508104A

United States Patent [19]

Onishi

[11] Patent Number: 5,508,104

[45] Date of Patent: Apr. 16, 1996

[54] NONVOLATILE THERMAL MICRO-CAPSULE TONER

[75] Inventor: Atsuhiro Onishi, Hyogo, Japan

[73] Assignee: Toyo Kasei Kogyo Company Limited, Osaka, Japan

[21] Appl. No.: 240,579

[22] Filed: May 11, 1994

[30] Foreign Application Priority Data

Jun. 1, 1993 [JP] Japan ..... 5-156177

[51] Int. Cl.[6] ..... B41M 5/28

[52] U.S. Cl. ..... 428/207; 428/195; 428/321.5; 428/402.24; 430/138; 503/215

[58] Field of Search ..... 428/321.5, 402.24, 428/206, 207, 195; 430/138; 503/215

[56] References Cited

U.S. PATENT DOCUMENTS

| | | | |
|---|---|---|---|
| 3,669,899 | 6/1972 | Vassiliades et al. | 428/402.24 |
| 4,564,534 | 1/1986 | Kushida et al. | 427/256 |

OTHER PUBLICATIONS

Kono et al., Journal of Membrane Science, vol. 76, "pH—responsive permeability of poly(acrylic acid)—poly(ethylenimine) complex capsule membrane", pp. 233–243, 1993.

Nakahara et al., Journal of Colloid and Interface Science, vol. 68, No. 3, "Effects of Surfactants on $CaCO_3$ Spheres Prepared by Interfacial Reaction Method", pp. 401–407, Mar. 1, 1979.

Oulton, Physical Structure of Cracking Catalyst, "The Pore Size—Surface Area Distribution of a Cracking Catalyst", pp. 1296–1315, Feb. 20, 1948.

*Primary Examiner*—B. Hamilton Hess

*Attorney, Agent, or Firm*—Wenderoth, Lind & Ponack

[57] ABSTRACT

The invention provides a novel micro-capsule toner, having a constitution and features absolutely differing the conventional counterpart, that has fully solved the conventional problem that the pattern may vanish. The toner is a novel thermal micro-capsule toner in which the micro-capsule is composed of two or more types of compositions, and in which a component that will be thermally decomposed to generate a gas has been added to the cell or core of the micro-capsule of the compositions, or to the interface between the cell and the core. The toner is added to a paint or an adhesive, or applied onto a carrier, or added to a moldable resin. By directly or indirectly heating, the toner allows a nonvolatile pattern to be developed. The micro-capsule will rupture by simple heating so that a nonvolatile patter is obtained. It becomes possible to print characters and images on various materials such as paper, synthetic resins, woods, and metals.

10 Claims, 1 Drawing Sheet

NONVOLATILE THERMAL MICRO-CAPSULE TONER

BACKGROUND OF THE INVENTION (1) Field of the Invention

The present invention relates to a novel nonvolatile thermal micro-capsule toner applicable to various fields, for drawing on paintings nonvolatile patterns that will not vanish, or for providing nonvolatile storage media by applying the toner onto paper or other carriers and heating it to print characters and images or by applying the toner onto a disk and impressing it with a laser beam, or for giving printed characters and images and the like that will not vanish by adding the toner to a moldable resin and, after molding, heating it.

(2) Description of the Prior Art

Conventionally, there have been available toners, for example, a thermally fixing use toner, with which a developed image of toner formed by the electrophotography, electrostatic printing, electric charge recording,.and the like is fixed to a recording member by heating (Japanese Patent Laid-Open Publication No. HEI 3-139663); a thermal roller fixing use micro-capsule type toner in similar use (Japanese Patent Laid-Open Publication No. SHO-61-56352); and a toner composition and the like which comprises toner particles composed of binder resin and coloring agent, and an additive smaller in mean particle size than the toner particles adhering onto the surface of the toner particles, the additive being composed of inorganic particles, the additive comprising an inorganic fine powder and a silicon oxide film chemically bonded onto the surface of the inorganic fine powder (Japanese Patent Laid-Open Publication No. HEI 3-150574). Furthermore, there has been proposed an invention of micro-capsule toner in which its core material containing an abrasive material is coated with a shell material (Japanese Patent Laid-Open Publication No. SHO 61-99154).

SUMMARY OF THE INVENTION

All of the above-described conventional toners, including thermal fixing use toners, thermal roller fixing use micro-capsule type toners or press-fixing use micro-capsule toners and moreover color toners, have been energetically investigated for the purpose of providing a toner good at fixing property when the toner is to be fixed by heating on recording paper or the like, or providing a color toner having a high image density and an excellent thin-line reproducibility in the case of color toners. However, conventional thermal toners have been mainly of the type that their chemical structure thermally varies and therefore, although high in thermal sensitivity, they are poor in environmental resistance, so that the pattern may vanish disadvantageously. It is therefore an object of the present invention to provide a novel micro-capsule toner having a structure and features different from those of the conventional micro-capsule toner by solving the aforementioned problem of the conventional toners that the pattern may vanish.

BRIEF DESCRIPTION OF SEVERAL VIEWS OF THE DRAWINGS

FIG. 1A shows a case where a foaming agent 3 has been added to the core together with a pigment 1. FIG. 1B shows another case where the foaming agent 3 has been added to the cell together with a pigment 2. FIG. 1C shows yet another case where a layer of the foaming agent 3 has been introduced to the interface between the pigment 1 and the pigment 2.

DETAILED DESCRIPTION OF THE PREFERRED EMBODIMENT

Figure 1A:
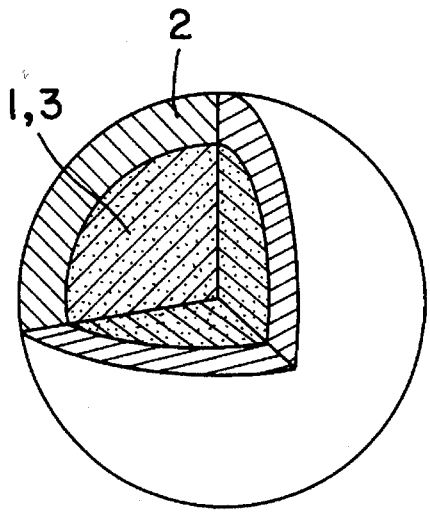
FIG. 1A, FIG. 1B, and FIG. 1C each illustrate an example of a micro-capsule used in the present invention.
Figure 1B:
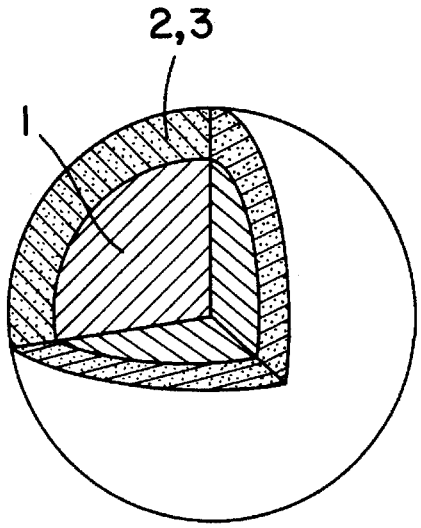
Figure 1C:
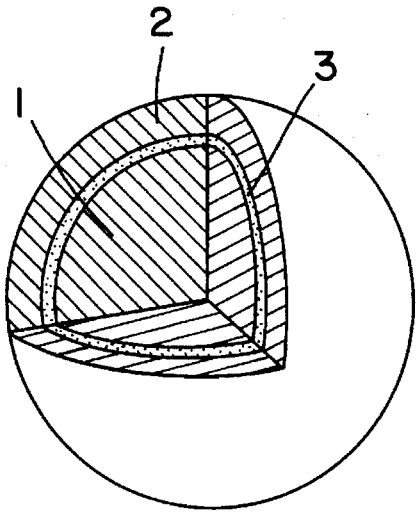

As a first aspect, the present invention provides a novel thermal micro-capsule toner characterized in that the micro-capsule is composed of two or more types of compositions of different colors, as shown in FIG. 1A, 1B, or 1C, and that a component which is thermally decomposed to generate a gas has been added to the cell or core of the micro-capsule of the compositions or to the interface between the cell and the core. As a second aspect, the present invention provides a nonvolatile thermal micro-capsule toner as described in the first aspect, wherein the micro-capsule is added to a paint or an adhesive so as to be applied to a carrier or added to a moldable resin. As a third aspect, the present invention provides a nonvolatile thermal micro-capsule toner as described in the second aspect, wherein the micro-capsule is heated directly or indirectly so that a nonvolatile pattern is developed.

In this case, the heating may be indirect heating, for example by corona discharge, light, laser beams, high-frequency waves, and the like, as well as direct fire. These types of heating allow a nonvolatile pattern to be developed. With a view to solving the problem of the conventional toners that the pattern may vanish, in the present invention, inorganic pigments or the like are used in the toner, where a pigment or the like of a desired color, used as the core, is coated with a pigment of a ground color so as to be micro-capsuled. In addition, in the present invention, a foaming agent is added to the core or cell or the interface between the core and the cell, in such an enough amount that a gas is generated by thermal decomposition to break the cell, causing the color of the core to be developed. The foaming agent may be any substance that will be thermally decomposed to generate a gas, such as diazo-based foaming agents typified by azodicarboamide, tetrazole-based compounds typified by 5-phenyl-1H-tetrazole, triazole, and carbazide-based compounds. Any one selected from those foaming agents may be used according to application conditions.

The micro-capsule is prepared by the following process. First, a component (foaming agent) that will be thermally decomposed to generate a gas is added in an appropriate amount to a pigment that will serve as the core, and the mixture is finely crushed. To the crushed product, a binder necessary for solidifying and molding the pigment component, for example, a crosslinkable acryl monomer is added in an amount necessary for the solidification and molding, and further a radical initiator to accelerate the reaction is added in a necessary amount. Then the mixture is well mixed to provide a core component. Meanwhile, water is filled in a reactive can that allows nitrogen gas to be introduced therein, in an amount sufficient to suspend the core component, and Poval, table salt, talc, and the like is added to the product to accelerate dispersion, thus providing a dispersed solution. Under a nitrogen stream, the core component is added to the dispersion under stirring, so as to be heated up to a temperature at which the acryl monomer reacts and solidifies. With heating due to reaction verified, aging is effected so that the reaction is sufficiently completed, whereby a core is formed. Particle size of the core can be controlled by the rate of stirring.

For formation of the cell, the amount of the pigment of ground color and the like added to the core is determined depending on how thick the cell is desired to be. These are well mixed, and an acryl monomer and a radical initiator are added to prepare a cell component, in the same manner as in the preparation of the foregoing core component. The product is made to react in the same manner as the core was formed, thereby making a cell formed on the surface of the core. The foaming agent may be added to the cell component instead of being added to the core, as required.

When the foaming agent is added to the interface between the cell and the core, a micro-capsule is formed in the following manner. The core is first formed in the same way as described above, and thereafter, by using an amount of foaming agent sufficient to break the cell by thermal decomposition, a layer of foaming agent is formed on the skin of the core in the same way as described above or by making the foaming agent adhering thereto with an adhesive. Further, the layer of foaming agent is coated with a pigment of ground color in the same way as described above to form a cell, thus completing a micro-capsule toner. Otherwise, when an inorganic micro-capsule is required, the micro-capsule toner can be prepared by referencing the micro-capsule preparation method which applies interface reaction with the use of the impregnation process, suspension process, or composite emulsion process as described in Keiko Nakahara, "Surface," vol. 25, No. 9 (1987).

When the film thickness of the cell is desired to be finished extremely thin, the dry mount process is preferable. After the core is prepared in the aforementioned way, for example, a mixture in which a radical initiator for starting polymerization has been added to an acryl monomer and which serves as an adhesive for forming the surface layer is applied to such an extent that the core is wetted. On this coating is sprinkled a mixture in which a foaming agent of enough amount to break the cell by thermal decomposition and a pigment of ground color of an amount determined by taking into account the thickness of the skin have been well mixed. Then the sprinkled mixture is well mixed so as to adhere uniformly to the surface and, thereafter, heated under a nitrogen stream and under stirring to accelerate its polymerization, thus forming the cell.

[EXAMPLES]

Next, the present invention is described with reference to examples thereof.

[Example 1] (Preparation of micro-capsule)

| | |
|---|---|
| A) Core components | |
| titanium oxide | 50 g |
| trimethylolpropane triacrylate | 100 g |
| bi-1H-tetrazole (foaming agent) | 3 g |
| perbutyl PV | 0.7 g |
| B) Dispersion components | |
| water | 300 ml |
| common salt | 0.5 g |
| Poval (10% aqueous solution) | 15 g |
| talc | 0.3 g |

Components of B) were poured into a 500 ml four-mouth flask equipped with a stirrer, a thermometer, and nitrogen-gas inlet and outlet. The flask was placed into a warm-water bath set to approximately 50° C. While a small amount of nitrogen gas was introduced and the warm water was stirred at a rate of 400 rpm, components of A) were added. In an elapse of about 30 min., the internal temperature was elevated to 65° C., where the reaction started. To further complete the reaction, the flask was allowed to stand for one hour as it was. The content of the flask was moved into a beaker after the reaction, and washed with water over and over to eliminate the additives and others, thus obtaining a core uniform in particle size with diameter approximately 50 μm at a yield of 90%. The core thus obtained was coated with carbon black in the following way:

| | |
|---|---|
| Core | 50 g |
| carbon black | 25 g |
| trimethylolpropane triacrylate | 80 g |
| perbutyl PV | 0.7 g |
| Dispersion components | |
| water | 300 ml |
| common salt | 0.5 g |
| Poval (10% aqueous solution) | 15 g |
| talc | 0.3 g |

These were made to react in the same manner as shown above, and the core surface was coated with carbon black. Thus, a micro-capsule uniform in particle size with diameter approximately 70 μm was obtained at a yield of 95%.

[Example 2] (Preparation of micro-capsule)

To the foaming agent as shown in Example 1, 5-phenyl-1H-tetrazole was added at not the core but the cell. Then a micro-capsule was prepared in the manner as described above. A micro-capsule with diameter approximately 70 μm was obtained at a yield of 82%.

[Example 3] (Preparation of micro-capsule)

| | |
|---|---|
| A) Core components | |
| titanium oxide | 50 g |
| trimethylolpropane triacrylate | 80 g |
| perbutyl PV | 0.7 g |
| B) Dispersion components | |
| water | 300 ml |
| common salt | 0.5 g |
| Poval (10% aqueous solution) | 15 g |
| talc | 0.3 g |

According to Example 1, a core was prepared. A micro-capsule with mean particle size 45 μm was obtained at a yield of 85%. By using the core thus obtained as a core material, the top surface of the core was coated with a foaming agent in the following composition:

| | |
|---|---|
| Core | 50 g |
| azodicarboamide | 15 g |
| trimethylolpropane triacrylate | 50 g |
| perbutyl PV | 0.4 g |
| Dispersion components | |
| water | 300 ml |
| common salt | 0.5 g |
| Poval (10% aqueous solution) | 10 g |
| talc | 0.1 g |

This surface layer was further coated with carbon black according to Example 1, thus completing the micro-capsule. A micro-capsule with mean particle size 75 μm was obtained at a yield of 82%.

[Example 4] (Preparation of micro-capsule)

A micro-capsule was prepared by using 5 g of Mn salt of bi-1H-tetrazole instead of azodicarboamide as a foaming agent in Example 3. A micro-capsule was obtained at the same yield as in Example 3.

In Example 1 or 2, also, 9 g of azodicarboamide as a diazo-based foaming agent, or 7 g of a triazole-based foaming agent, or 6 g of a carbazide-based foaming agent may be used instead of bi-1H-tetrazole (3 g) as a foaming agent, to obtain a similar micro-capsule at a similar yield. Thus, they may be used as the micro-capsule of the present invention.

[Example 5] (Preparation of micro-capsule)

A core material of titanium white was prepared in the manner as described above.

With the following components:

| | |
|---|---|
| core material (32–60 mesh) | 50 g |
| TMPT | 20 g |
| perbutyl PV | 0.2 g, |

the surface of the core material was enough wetted, and

| | |
|---|---|
| carbon black | 15 g |
| BHT-Mn | 6 g |

were added and, after fully mixed, allowed to react under a nitrogen stream at 60° C. for 2 hours, under rotation by utilizing a rotary evaporator. To completely blacken non-deposited part, the reaction was effected again with the following blend:

| | |
|---|---|
| precoated core | abt 350 g |
| TMPT | 15–18 g |
| perbutyl PV | 0.15 g |
| carbon black | 5 g |

As a result, a fine micro-capsule holding the basic grain size was prepared substantially quantitatively. The following table lists the results of analysis of grain size distribution and amount of deposition of BHT-Mn.

TABLE 1

| Lot No. | BHT-Mn content | Particle size (50% size) μm | | |
|---|---|---|---|---|
| | | First | Second | Average |
| 1 | 0.351(0.399) | 336.03 | 343.75 | 339.89 |
| 2 | 0.352(0.399) | 313.63 | 311.49 | 312.56 |
| 3 | 0.355(0.399) | 378.58 | 374.53 | 376.55 |
| 4 | 0.361(0.399) | 308.78 | 311.88 | 310.33 |
| 5 | 0.354(0.399) | 319.01 | 314.75 | 316.88 |
| 6 | 0.353(0.399) | 433.30 | 439.55 | 436.42 |
| Core material* | 0 | 401.61 | 401.79 | 401.70 |

Note: Parenthesized numerals are theoretical amounts of addition.

[Example 6]

Fifty parts of micro-capsules obtained in Example 1 were mixed in 100 parts of acryl paint of black color, sprayed to coat an iron plate of a 3 mm thickness, and dried. Thus, a coating film containing micro-capsules was completed. The iron plate was grounded and, with an electrode approached to the coating surface, corona discharging was performed. Micro-capsules at portions subjected to discharge ruptured, so that their internal white pigment appeared, and impressed according to the movement of the electrode.

[Example 7]

Seventy parts of micro-capsules prepared in Example 3 were well mixed with 30 parts of a vinyl-based adhesive and the mixture was applied onto a veneered wood of a 3 mm thickness. On the veneered wood, a pattern was drawn by a red-hot soldering iron. As a result, the surface micro-capsules ruptured according to the movement of the soldering iron so that a pattern appeared.

[Example 8]

Micro-capsules prepared in Example 4 were added to 10% by weight to a resin of nylon 6, and 50 mm×50 mm×6 mm test pieces were made by an injection molding machine. When a red-hot branding iron was approached to this, the micro-capsules on the surface of the test pieces ruptured, so that a pattern of the branding iron appeared.

[Effect of The Invention]

The existing thermal toners in most cases have suffered a number of problems, for example, a pattern may vanish due to long-time exposure to environment. The thermal micro-capsule toner of the present invention allows a nonvolatile pattern to be obtained by micro-capsules rupturing by a simple process such as heating.

Consequently, coatings or moldings to which the micro-capsules have been added will rupture due to a gas-generating substance by heating reaction, so that a nonvolatile pattern will appear. Thus, it has become possible to impress characters and images on various types of materials such as paper, synthetic resins, woods, and metals.

What is claimed is:

1. A nonvolatile thermal micro-capsule toner composition comprising a micro-capsule having an inner core coated with an outer cell layer, wherein the microcapsule comprises:

two or more nonvolatile pigments of different colors which are present in the inner core, outer cell layer or both the inner core and outer cell layer and a foaming agent present in the outer cell layer, core or the interface between the outer cell layer or core.

2. A nonvolatile thermal micro-capsule toner composition according to claim 1, wherein the foaming agent is present in the outer cell layer.

3. A nonvolatile thermal micro-capsule toner composition according to claim 1, wherein a nonvolatile pigment is present in the outer cell layer.

4. A nonvolatile thermal micro-capsule toner composition according to claim 1, wherein a nonvolatile pigment and a foaming agent are present in the outer cell layer.

5. A nonvolatile thermal micro-capsule toner composition according to claim 1, wherein the microcapsule has a particle size of at least 50 μm.

6. A nonvolatile thermal micro-capsule toner composition according to claim 1, wherein the microcapsule has a particle size of at least 50 μm to about 75 μm.

7. A composition nonvolatile thermal micro-capsule toner composition of claim 1, wherein the composition is selected from the group consisting of paint, adhesives and moldable resins.

8. A nonvolatile pattern impressed on a material which is formed by heating the nonvolatile thermal micro-capsule toner composition of claim 1 in contact with the material.

9. A nonvolatile pattern according to claim 8 wherein heating occurs by fire, corona discharge, light, laser beam or high-frequency waves.

10. A nonvolatile pattern according to claim 8, wherein the material is paper, synthetic resin, wood or metal.

* * * * *